United States Patent [19]

Fricke

[11] Patent Number: 4,516,475

[45] Date of Patent: May 14, 1985

[54] HYDROSTATIC PISTON MACHINE

[75] Inventor: Hans-Jürgen Fricke, Stuttgart, Fed. Rep. of Germany

[73] Assignee: Robert Bosch GmbH, Stuttgart, Fed. Rep. of Germany

[21] Appl. No.: 136,971

[22] Filed: Apr. 3, 1980

Related U.S. Application Data

[63] Continuation of Ser. No. 906,647, May 16, 1978, abandoned.

[30] Foreign Application Priority Data

Jul. 2, 1977 [DE] Fed. Rep. of Germany ..... 2730034

[51] Int. Cl.[3] ..... F01B 13/04

[52] U.S. Cl. ..... 92/57; 92/58; 92/71; 92/72; 92/158; 91/488

[58] Field of Search ..... 92/12.1, 12.2, 57, 58, 92/70, 71, 72, 147, 148, 153, 158, 159; 91/488, 491, 499; 308/9

[56] References Cited

U.S. PATENT DOCUMENTS

| | | | |
|---|---|---|---|
| 2,821,932 | 2/1958 | Lucien | 417/269 |
| 3,744,380 | 7/1973 | Steiger | 91/488 |
| 3,803,985 | 4/1974 | Maistrelli | 91/488 |
| 3,818,803 | 6/1974 | Scott | 91/499 |
| 3,866,518 | 2/1975 | Miyao | 91/488 |
| 3,898,917 | 8/1975 | Adams | 91/488 |
| 4,183,288 | 1/1980 | Miyao | 91/488 |

FOREIGN PATENT DOCUMENTS

| | | | |
|---|---|---|---|
| 2460393 | 7/1975 | Fed. Rep. of Germany | 91/488 |
| 1340793 | 12/1973 | United Kingdom | 91/488 |

*Primary Examiner*—Abraham Hershkovitz
*Attorney, Agent, or Firm*—Michael J. Striker

[57] ABSTRACT

A hydrostatic piston machine has a housing, a rotor, a plurality of pistons rotatable with the rotor, and a displacing element operative for effecting reciprocation of the pistons and having a surface which is in sliding contact with the latter. Means is provided for reducing friction between the surface of the displacing element and the pistons during the sliding contact. This means includes a recess formed in the surface of the displacing element and communicating with a space which is under pressure so that a cushion of pressure fluid develops between the surface and the piston. The space under pressure may be constituted by a low pressure zone of the machine or by the low pressure and a high pressure zone of the machine.

8 Claims, 5 Drawing Figures

HYDROSTATIC PISTON MACHINE

This is a continuation, of application Ser. No. 906,647, filed May 16, 1978 now abandoned.

BACKGROUND OF THE INVENTION

The present invention relates to a hydrostatic piston machine.

Hydrostatic piston machines having a rotor, a plurality of pistons rotatable with the rotor, and a displacing element operative for effecting reciprocation of the pistons, have been widely known. The displacing element has a surface which is in sliding contact with the pistons, and more particularly with sliding shoes of the piston. In the known hydrostatic piston machines, a portion of the above-mentioned surface of the displacing element, which is in sliding contact with the sliding shoes of the pistons has been formed as a smooth surface. It has been shown that during rotation of the pistons relative to the displacement member when the sliding shoes of the pistons are in sliding contact with the surface of the displacing member, increasing friction losses take place as a result of viscous friction therebetween. These friction losses result in loss in efficiency of the hydrostatic piston machine. This is particularly characteristic when the machine operates with a great number of revolutions.

SUMMARY OF THE INVENTION

Accordingly, it is an object of the present invention to provide a hydrostatic piston machine which avoids the above-mentioned disadvantages of the prior art.

More particularly, it is an object of the present invention to provide a hydrostatic piston machine in which viscous friction of sliding parts is reduced particularly in the case when the machine operates with a great number of revolutions.

In keeping with these objects and with others which will become apparent hereafter, one feature of the present invention resides, briefly stated, in a hydrostatic piston machine which has a housing, a rotor, a plurality of pistons rotatable with the rotor, a displacement element operative for effecting reciprocation of the pistons and having a surface which is in sliding contact with the latter, wherein means for reducing friction between the surface of the displacement element and the pistons during the sliding contact is provided. This means includes a recess formed in the surface of the displacing element and communicating with a space which is under pressure. In such a construction a cushion of pressure fluid develops between the surface of the displacing element and the pistons during the sliding contact of the former with the latter, whereby friction between the surface of the displacing element and the pistons is reduced.

Each of the pistons may have a piston member and a sliding shoe movably connected therewith, in which case the sliding shoes of the pistons are in sliding contact with the surface of the displacing element. The above-mentioned surface of the displacing element has a portion with which the sliding shoes are in sliding contact, and the recess communicating with the space under pressure is formed in this portion of the surface of the displacement element.

In accordance with another feature of the present invention, the machine has a low pressure zone and a high pressure zone, and the space under pressure with which the recess of the reducing means communicates, is constituted by the low pressure zone of the machine.

In accordance with still another feature of the present invention the recess communicating with the space which is under pressure, is shallow and has a relatively small depth. The recess has a width which is smaller than a width of each of the sliding shoes of the pistons.

A further feature of the present invention is that the displacing element, particularly in an axial piston machine, may be constituted by a wobble plate having a flat surface which forms said first-mentioned surface of the displacing element. The recess communicating with a space which is under pressure, is formed in the flat surface of the wobble plate. A still further feature of the present invention is that the recess communicating with the space which is under pressure may have a circular shape, and particularly may be arcuate.

An additional feature of the present invention is that this recess may have an axis of symmetry which extends through axes of the sliding shoes of the pistons. On the other hand, the recess may extend symmetrically relative to the low pressure zone of the machine.

A still additional feature of the present invention is that the displacing element, particularly in a radial piston machine, may be constituted by a ring member having an annular surface which forms the first-mentioned surface of the displacing element, and the recess communicating with the space which is under pressure may be formed in the annular surface of the ring member.

A yet further feature of the present invention is that the space which is under pressure and with which the recess of the friction reducing means communicates, may be constituted by the low pressure and high pressure zones of the machines. Such a recess may be circumferentially complete.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
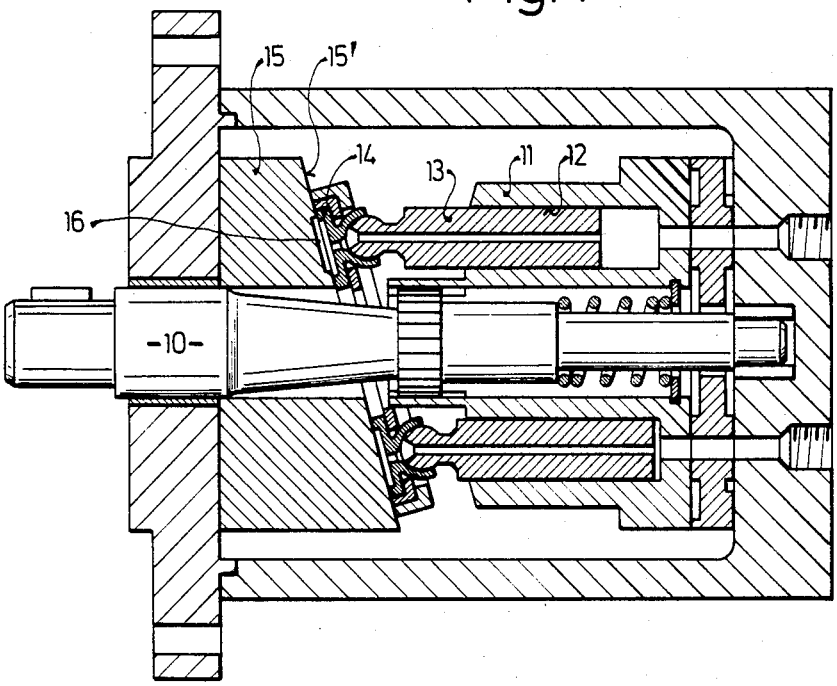
FIG. 1 is a view showing an axial section of an axial piston machine in accordance with the present invention.

Referring now to the drawing, it should be understood that no attempt has been made to illustrate those aspects of a hydrostatic piston machine which are conventional, i.e., known per se. Only those aspects of the hydrostatic piston machine are illustrated in the drawing which are substantial for the present invention.

With this in mind it will be seen that FIG. 1 shows an axial piston machine having a housing H and a driving shaft 10 which drives a rotor 11. Holes 12 are provided in the rotor, in which holes pistons 13 slide in sealing contact with surfaces of the holes. The pistons 13 are supported on a wobble plate 15 through sliding shoes 14 of the pistons.

Figure 2:
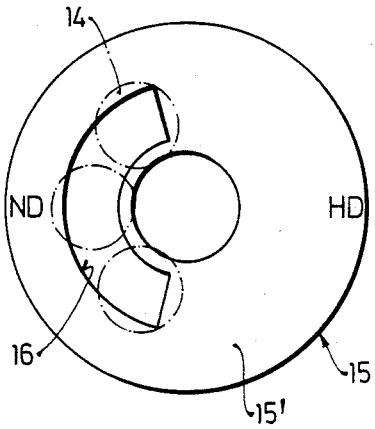
FIG. 2 is a plan view of a contact surface of a wobble plate of the machine shown in FIG. 1.

The wobble plate 15 has a contact surface 15' in which a recess 16 is formed. The recess 16 has a circular shape, and preferably is arcuate. The recess 16 extends along an angular distance which may be smaller than 180° of arc. This distance may correspond substantially to between 130° and 180° of arc. The recess 16 is shallow and has a relatively small depth. A width of the recess 16 is somewhat smaller than the width of the sliding shoes 14 which contact the contact surface 15' of the wobble plate 15. In other words, the width of the recess 16 is somewhat smaller than the outer diameter of the sliding shoes 14. An axis of symmetry of the recess 16 extends along a curve which is described by centers of the sliding shoes 14. The recess 16 communicates with a space which is under pressure. This space may be constituted by a low pressure zone or a suction zone of the machine. The width 16 may extend symmetrically with respect to the low pressure of the machine, as shown in FIG. 2.

In operation of the machine a hydrostatic and/or hydrodynamic pressure field is built under the sliding shoes 14 of the pistons 13, which pressure field compensates for the force exerted by the pistons 13. Surfaces of the sliding shoes 14 and the wobble plate 15, which face toward one another, are separated from one another by a film of pressure fluid. Viscous friction between these surfaces increases with increase of a number of revolutions of the machine. Due to the provision of the recess 16 the viscous friction at a great number of revolutions is reduced. Hydromechanic efficiency of the machine is improved as a result of the reduction of friction between the sliding shoes 14 of the pistons 13 and the contact surface 15' of the wobble plate 15.

Figure 3:
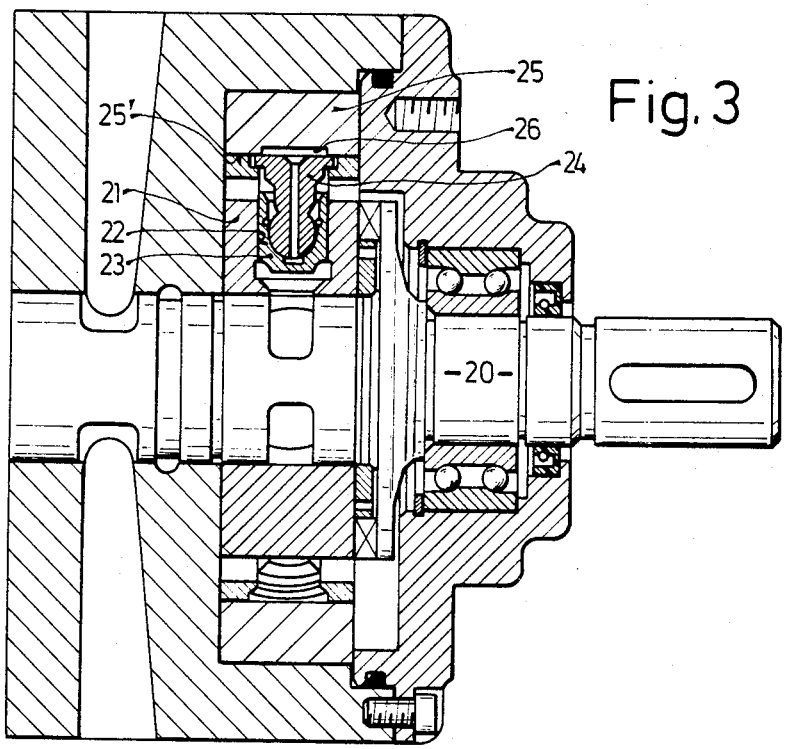
FIG. 3 is a view showing an axial section of a radial piston machine in accordance with the present invention.
Figure 4:
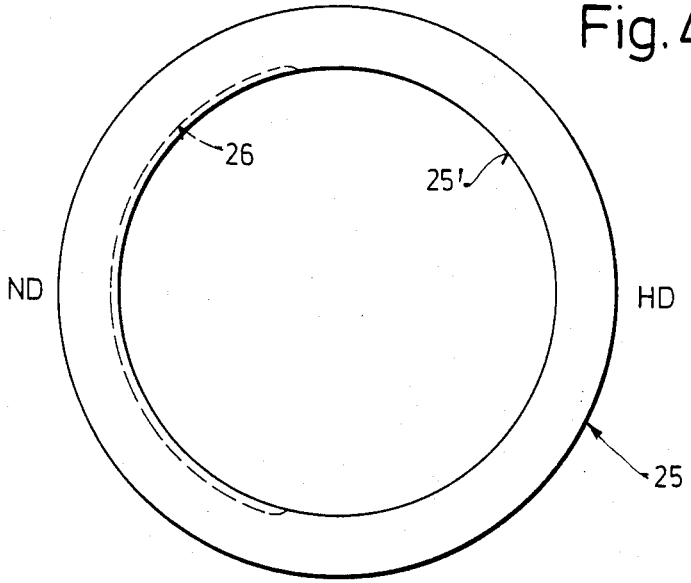
FIG. 4 is a side view showing a displacement ring of the machine shown in FIG. 3.

FIGS. 3 and 4 shows a radial piston pump in accordance with the present invention. A driving shaft 20 drives a rotor 21. Pistons 23 slide in radial holes 22 of the rotor 21 in sealing contact with surfaces of the holes 22. Sliding shoes 24 of the pistons 23 are supported on a displacement ring 25. The latter has a contact surface 25' in which a recess 26 is formed. The recess 26 has a small depth, and a width which is somewhat smaller than that of the sliding shoes 24. The recess 26 communicates with a low pressure zone or a suction zone of the machine. The recess 26 extends along an angular distance which is somewhat smaller than 180° of arc. In FIGS. 2 and 4, the low pressure zone is identified by reference letters ND and the high pressure zone is identified with reference letters HD. The contact surface 25' of the displacement ring 25 is annular, and the recess 26 is formed in this annular surface.

The operation of the radial piston pump in accordance with the invention, which is shown in FIGS. 3 and 4 is not described inasmuch as it is believed to be the same as described hereinabove.

Figure 5:
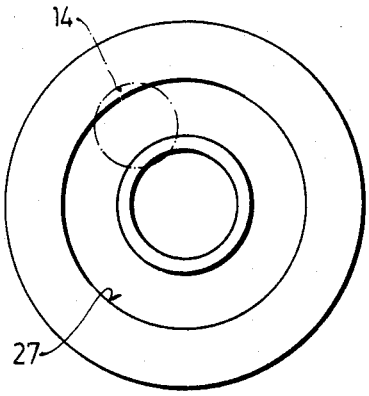
FIG. 5 is a view showing another embodiment of the displacement elements of the machines shown in FIGS. 1 and 2.

When the sliding shoes of the pistons are subjected to hydrodynamic unloading, it may be advisable to provide such a recess on a contact surface of corresponding displacement elements which communicates both with the low pressure zone and the high pressure zone of the machine. Such a recess is shown in FIG. 5 of the drawing and identified by reference numeral 27. The recess 27 is circumferentially closed.

It will be understood that each of the elements described above, or two or more together, may also find a useful application in other types of constructions, differing from the types described above.

While the invention has been illustrated and described as embodied in a hydrostatic piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpont of prior art, fairly constitute essential characteristics of the generic or specific aspects of this invention.

What is claimed as new and desired to be protected by Letters Patent is set forth in the appended claims:

1. A hydrostatic piston machine, comprising a housing with a pressure fluid and forming a low pressure zone and a high pressure zone; a rotor in said housing; a plurality of pistons in said housing and rotatable with said rotor, said pistons including sliding shoes at the ends thereof; a displacing element operative for effecting reciprocation of said pistons, and having a surface including a contact portion which is in sliding contact with said shoes and separated therefrom by a film of a pressure fluid; and means for reducing viscous friction between said surface of said displacing element and said shoes during said sliding contact, said means including a closed arcuate recess formed in said contact portion of said surface of said displacing element and extending along an arcuate distance in the range 130°–180°, said recess being shallow of a relatively small depth and being located in the region of said low pressure zone and communicating with the latter.

2. The machine as defined in claim 1, wherein said rotor has a plurality of openings, each of said pistons being slidably received into a respective one of said openings.

3. The machine as defined in claim 1, wherein each of said sliding shoes has a predetermined width, said recess having a width which is smaller than said width of each of said sliding shoes.

4. The machine as defined in claim 1, particularly an axial piston machine, wherein said displacing element is constituted by a wobble plate having a flat surface which forms said first mentioned surface of said displacing element, said recess being formed in said flat surface of said wobble plate.

5. The machine as defined in claim 4, wherein said recess has a circular shape.

6. The machine as defined in claim 5, wherein each of said sliding shoes has an axis, said recess having an axis of symmetry extending through said axes of said sliding shoes.

7. The machine as defined in claim 5, wherein said recess extends symmetrically relative to said low pressure zone.

8. The machine as defined in claim 1, particularly a radial piston machine, wherein said displacing element is constituted by a ring member having an annular surface which forms said first-mentioned surface of said displacing element, said recess being formed in said annular surface of said ring member.

* * * * *